United States Patent [19]

Koks

[11] 4,267,875

[45] May 19, 1981

[54] SLIDING CLUTCH FOR VENETIAN BLIND

[75] Inventor: Marinus F. Koks, Rotterdam, Netherlands

[73] Assignee: Hunter Douglas International N.V., Netherlands

[21] Appl. No.: 13,278

[22] Filed: Feb. 21, 1979

[30] Foreign Application Priority Data

Feb. 22, 1978 [DE] Fed. Rep. of Germany ..... 2807440

[51] Int. Cl.[3] ..... E06B 9/26

[52] U.S. Cl. ..... 160/176 R; 160/168 R

[58] Field of Search ..... 160/166–178

[56] References Cited

U.S. PATENT DOCUMENTS

| | | | |
|---|---|---|---|
| 3,028,910 | 4/1962 | Bopp et al. | 160/177 |
| 3,455,364 | 7/1969 | Fukuka | 160/172 |
| 3,463,219 | 8/1969 | Osterholz | 160/172 |
| 3,860,056 | 1/1975 | Bruneau | 160/176 |
| 3,996,988 | 12/1976 | de Wit | 160/176 R |
| 4,122,885 | 10/1978 | Marotto | 160/176 R |

*Primary Examiner*—Peter M. Caun

*Attorney, Agent, or Firm*—Pennie & Edmonds

[57] ABSTRACT

A clutch mechanism (9*a*, 9*b*) for a vertical venetian blind is disclosed in which a first clutch part (9*a*) is mounted for sliding relationship on, but non-rotatable with respect to, a rotatable drive shaft (8). A second clutch part (9*b*) has a cylinderical portion (9*e*) surrounding the hub (9*f*) of the first clutch part (9*a*). The second clutch part (9*b*) is mounted for rotation about and slidably movable along the axis of drive shaft (8). Toothed gear faces (10*a*, 10*b*) on clutch parts (9*a*, 9*b*) are engageable upon rotation of the drive shaft (8) to rotate a hook (14) carrying a slat (1*b*) to rotate the slat. The walls (2*a*, 2*b*) of the housing (2) are resilient to permit axial engagement and disengagement of the gear faces (10*a*, 10*b*). When the slat (1*b*) has reached the limit of its travel, a worm (11) on part (9*b*) engages a stop (15 or 16), preventing further rotation of part (9*e*). Continued torque applied to part (9*a*) forces parts (9*a* and 9*b*) apart against the resilient pressure applied thereto by the walls (2*a*, 2*b*) of housing (2). After the excess torque is released, the walls (2*a*, 2*b*) resiliently re-engage gear faces (10a, 10b) by moving parts (9*a*, 9*b*) toward each other.

11 Claims, 4 Drawing Figures

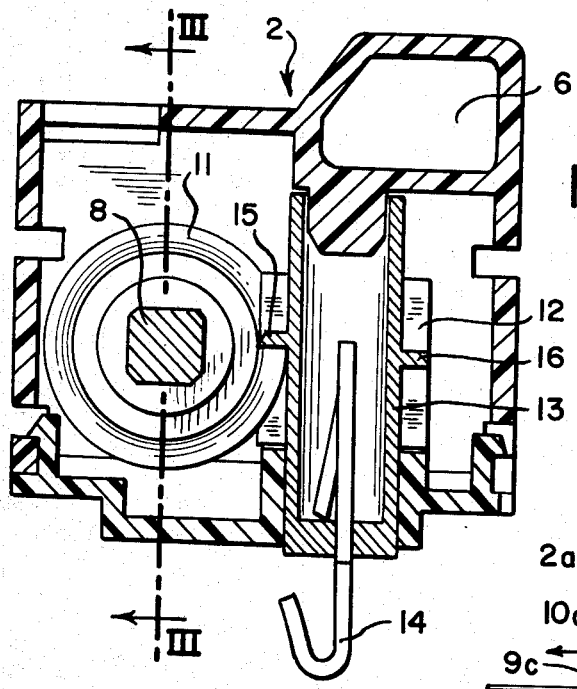
FIG. 2
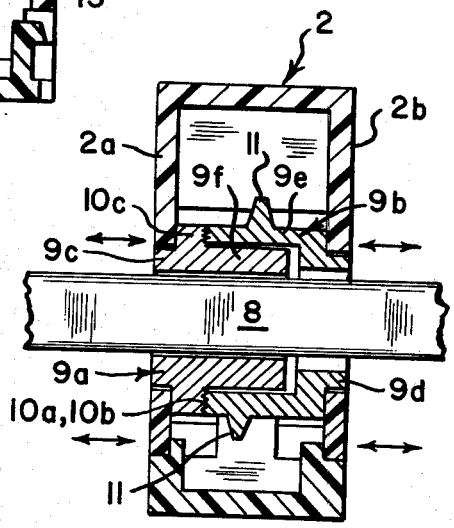
FIG. 3
FIG. 4
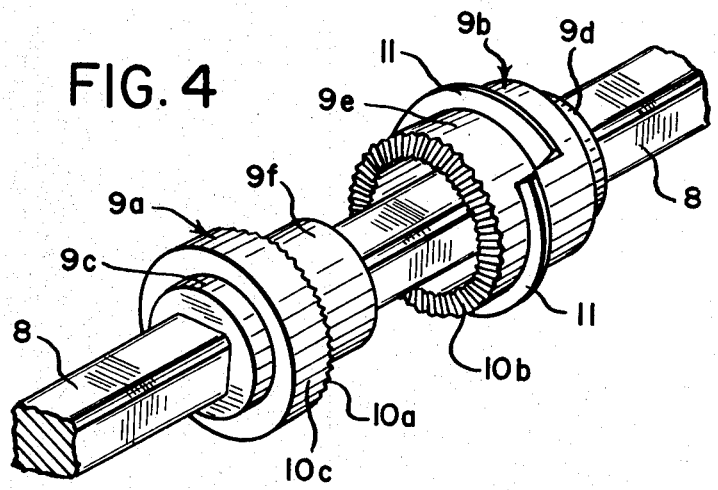

SLIDING CLUTCH FOR VENETIAN BLIND

BACKGROUND OF THE INVENTION

1. Field of the Invention

This application concerns the field of clutch drive mechanisms, particularly suitable for vertical venetian blinds, having a plurality of slats in which each slat is provided with a carriage mounted in a top rail. In such blinds, a drive shaft is provided in the top rail and a clutch mechanism is interposed between the drive shaft and each slat, in order to rotate each slat about its vertical axis relative to its carriage. Various gear and clutch mechanisms have been proposed for transmitting the motion of the drive shaft to the slats and the present invention is directed to such a clutch mechanism.

2. Prior Art

One known means for achieving the rotation of the slats to open and close the venetian blind disclosed in U.S. Pat. No. 3,996,988 comprises a drive shaft extending through each of the carriages which drives a sliding clutch that, in turn, rotates the slat. The clutch includes a first bushing slidably mounted on the drive shaft but non-rotatable with respect to the shaft. The bushing has an outer surface that is other than round provided by a plurality of reinforcing enlargements on its outer surface. These enlargements are in friction contact with the inner surface of a bore in a worm gear. The friction between these enlargements and the bore in the worm gear is sufficient to provide rotation of the worm and thus rotation of the slats; however, when the worm reaches a stop provided for the purpose, further rotation of the worm gear is prevented. At this point the friction between the enlargements on the inner bushing and the inner surface of the bore is overcome by the torque applied to the inner bushing by the drive shaft. Accordingly, the inner bushing continues to rotate by slipping within the bore of the now stationary worm gear.

In actual practice, it has been found that this design has a number of drawbacks. In order for the clutch of this design to work well, the dimensions of the inner surface of the bore in the worm gear and the enlargements on the bushing must be maintained within very small tolerances. Indeed, in series production of venetian blinds, it has been found exceedingly difficult to maintain the tolerances required for proper operation of the blind.

BRIEF DESCRIPTION OF THE INVENTION

The present invention is directed toward the solution of the problem existing with presently available sliding clutches for venetian blinds, by use of a clutch having two parts, one of which is slidable on but non-rotatably with respect to the drive shaft. A second part of the clutch is freely rotatable with respect to the drive shaft. Both parts are mounted in a combination carriage-housing provided for each slat. The second clutch part has on its circumference a spiral which comprises one turn or thread of a worm gear which engages a gear wheel mounted on a vertical axis and to which gear wheel the vertical slat is fixed for support and rotation. Each of the clutch parts has a boss mounted in a wall of the housing for rotation with respect thereto. Each of the parts also have a circular gear face in engagement with a like gear face on the other part.

The walls of the housing are resilient, thus permitting the gear faces on the two parts to disengage or engage, depending upon the resistance encountered by the worm gear in rotating the slat. A pair of stops are provided in the gear wheel at selected locations to insure that the slats cease rotation at the desired open and closed positions. When the spiral on the second clutch part reaches a stop, it can no longer rotate and when further torque is applied to the first gear part, the gear face on the first clutch part attempts to slide with respect to the gear face on the second clutch part. In order for this to occur, the two clutch parts must move away from each other axially of the drive shaft as the teeth faces on the two gear faces move with respect to each other. The walls of the housing being resilient permit this small amount of axial movement, while at the same time insuring re-engagement of the gear faces instantly when the excess torque is released on the drive shaft.

BRIEF DESCRIPTION OF THE DRAWINGS

The construction and operation of the invention will be apparent to those skilled in the art from the following description and the accompanying drawings, in which:

FIG. 2 is a cross-section through a slat carriage-housing;

FIG. 3 is a cross-section taken along the line III—III in FIG. 2; and

FIG. 4 is a perspective detail of the drive shaft and the two elements of the clutch.

DETAILED DESCRIPTION OF THE INVENTION

Figure 1:
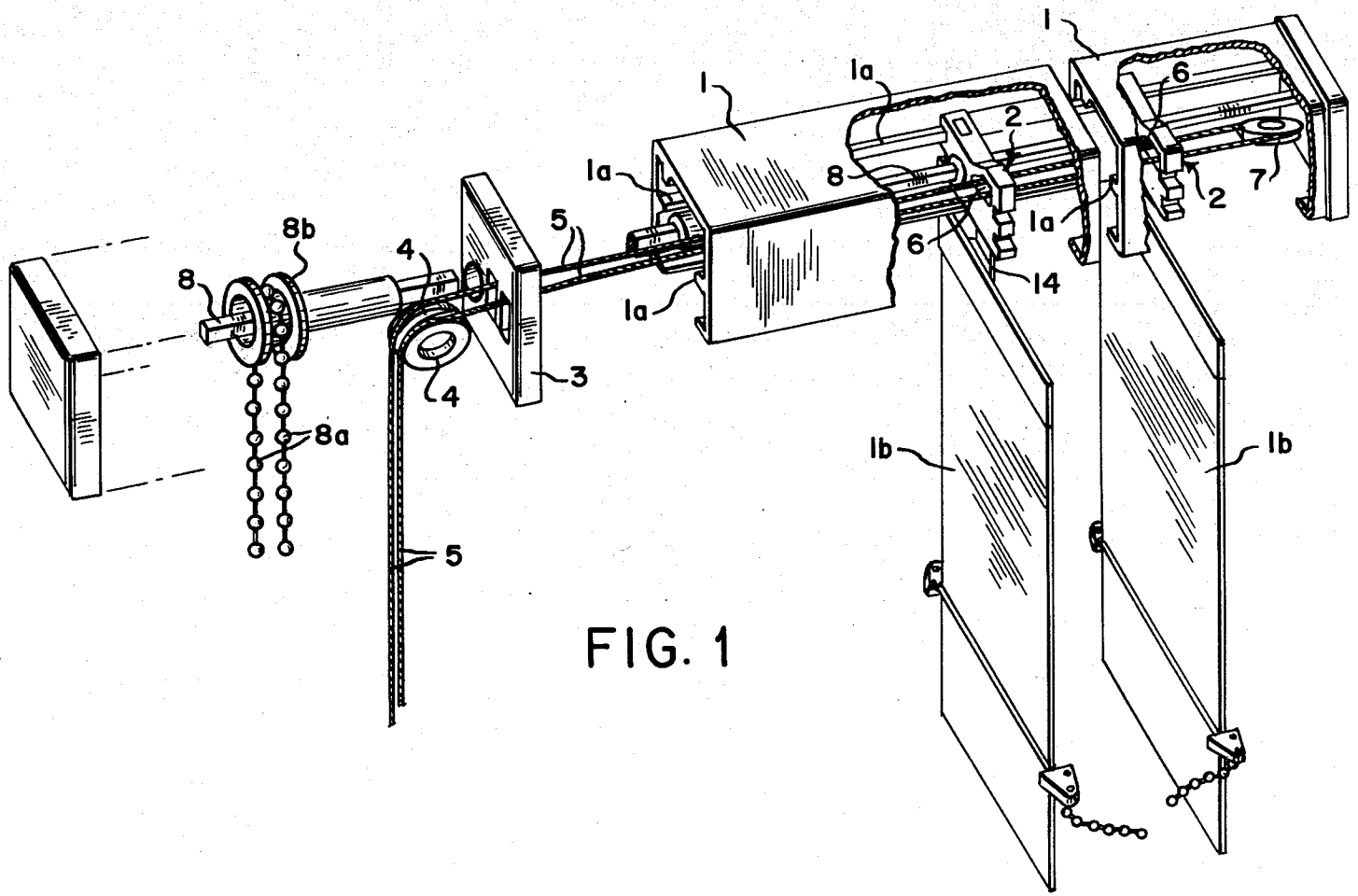
FIG. 1 is a schematic perspective view of a venetian blind with certain parts omitted for clarity.

As shown in FIG. 1, a venetian blind comprises a top rail 1 which is generally an inverted U-shape in construction with a longitudinal opening on its underside. Slidably arranged on tracks 1*a* in the top rail 1 are a plurality of combination carriage-housings 2, there being one carriage-housing 2 for each slat 1*b*. The several housings 2 are coupled together in a well-known manner (not shown here) so that they may be all pushed together in a pack at one end or, alternatively, may be distributed throughout the length of the top rail at regular prescribed intervals. To this end, a cord 5 is provided that extends over a pulley 4 mounted on a horizontal axis in a pulley support 3. The cord 5 then extends through openings 6 in housings 2 toward the opposite end of the top rail 1 where it is entrained around another pulley 7 and then returns through the openings 6 and passes over a second pulley 4, also mounted in the pulley support 3. By pulling one run of the cord 5, the slats 1*b* may be arranged at regular intervals along the rail or grouped in a pack at one end due to the fact that one run of the cord is secured (not shown) to the last housing 2 on one end. All of the above arrangement is known, and it is described here merely to provide a suitable environment for the invention.

For rotating slats 1*b* about their individual vertical axes, a drive shaft 8 is provided which is rotated by a chain 8*a* which may be a ball chain operating in a ball chain pulley 8*b*, as shown, or may be of a flexible cord material, all in known manner. The drive shaft 8 extends the full length of the top rail and extends through each of the housings 2. Each of the housings 2 may slide with respect to the drive shaft 8 as will be hereinafter apparent.

Having reference to FIGS. 2 and 3, there is shown a first clutch part 9*a* having a boss or bearing portion 9*c* on one end thereof. The boss 9*c* is received in an opening in wall 2*a* for rotation with respect thereto. As shown, the drive shaft 8 has a square cross-section and is received in a square opening within the clutch part 9*a*. Accordingly, the clutch part 9*a* is non-rotatably mounted with respect to the drive shaft 8; however, the opening in clutch part 9*a* is so dimensioned as to permit the clutch part 9*a* to readily slide along the drive shaft 8.

A second generally drum-shaped clutch part 9*b* has a generally cylindrical body portion 9*e* which encircles the hub 9*f* of the first clutch part 9*a*. The second clutch part 9*b* also has an axially extending boss 9*d* received for rotation in a suitable opening in wall 2*b* of the housing 2. As will be clearly seen from FIG. 3, the entire housing 2, including clutch parts 9*a* and 9*b*, can readily slide along the drive shaft 8 in either direction; however, rotation of the drive shaft 8 will always effect rotation of the first clutch part 9*a*.

As best shown in FIG. 4, clutch parts 9*a* and 9*b* have mutually engageable toothed gear faces 10*a*, 10*b*. When the teeth of gear face 10*a*, located on flange 10*c* of clutch part 9*a*, are engaged with the teeth of gear face 10*b*, located on the annular edge of body portion 9*e* of the clutch part 9*b*, rotation of drive shaft 8 will effect rotation of clutch part 9*a* and also rotation of clutch part 9*b*. Clutch part 9*b* has a spiral 11 which essentially comprises one turn of a worm gear. This spiral 11 is in engagement with the teeth of a gear wheel 12 secured to the outer surface of a bushing 13. At its lower end, the bushing 13 supports a hook 14 which, in turn, supports a slat 1*b*. Accordingly, rotation of clutch part 9*b* will cause rotation of spiral 11 which, in turn, through its engagement with the teeth of gear wheel 12 will rotate the gear wheel 12, the bushing 13, the hook 14 and the slat 1*b*.

Suitable stops 15 and 16 are provided on the gear wheel 12 at preselected locations corresponding to the open and closed position of the slats. When the drive shaft 8 is operated to rotate clutch part 9*a* and clutch part 9*b*, the spiral 11 will rotate the slat 1*b*, as just mentioned, until the end of the spiral 11 comes up against either the stop 15 or the stop 16. When this occurs, the clutch part 9*b* can no longer rotate and if continued torque is applied to the drive shaft, the clutch part 9*a* attempts to continue to rotate. In attempting to do so, the faces of the teeth in gear face 10*a* slide along the faces of the teeth in gear face 10*b*, trying to force the parts 9*a* and 9*b* apart, i.e. away from each other axially of the drive shaft 8. The walls 2*a* and 2*b* of carriage-housing 2 are sufficiently resilient to permit this limited movement apart of the parts 9*a* and 9*b*, whereby the drive shaft 8 and clutch part 9*a* may continue to rotate without driving clutch part 9*b*.

However, when the torque applied to the drive shaft 8 is stopped, the resiliency in the walls 2*a* and 2*b* will promptly urge the parts 9*a* and 9*b* toward each other, thus re-engaging gear faces 10*a* and 10*b*. At this point, the drive shaft 8 may be rotated in the opposite direction to open or close the slats until the other end of spiral 11 comes up against stop 15 or 16, as the case may be. At this time, clutch parts 9*a* and 9*b* again slide axially apart as permitted by the walls 2*a*, 2*b* to prevent further rotation of the part 9*b* and the slat 1*b*. The housing 2, including particularly the housing walls 2*a* and 2*b*, may be made from any suitable material, it being only necessary that the walls 2*a* and 2*b* exhibit sufficient resiliency to permit the two clutch parts 9*a* and 9*b* to move apart and to have sufficient recoverability as to move the two parts back into engagement again. It is preferred to use a molded plastic which in the thickness of walls used for the housing 2 is sufficiently elastic or resilient for the purpose. The amount of movement of the parts 9*a* and 9*b* is not great, being only enough to disengage gear faces 10*a* and 10*b*. That is, essentially, a movement of approximately the depth of the teeth on gear faces 10*a* and 10*b*.

Modified Embodiments

In the preferred structure disclosed above, both walls 2*a* and 2*b* are constructed of suitably resilient or elastic material so that both walls 2*a* and 2*b* may yield to permit the parts 9*a* and 9*b* to move apart to disengage gear faces 10*a* and 10*b*. It will be apparent to those skilled in the art, however, that either one of walls 2*a* and 2*b* could be constructed so as to be relatively rigid and inelastic as long as the other wall 2*a* or 2*b* (as the case may be) is made sufficiently resilient. When only one wall is made resilient in this manner, it must be sufficiently resilient to provide for all of the movement necessary to disengage gear faces 10*a* and 10*b*, whereas in the preferred embodiment described above the necessary movement is divided between the two resilient walls 2*a* and 2*b*.

As will also be apparent, it is also possible to provide only a single clutch mechanism for the entire series of slats of a blind, in which event the single clutch would be disposed between the ball chain pulley 8*b* and the shaft 8 before the first clutch-housing 2. In such an arrangement, the drive shaft 8 would then carry a simple worm gear fixed for rotation therewith for each individual gear 12 to rotate each gear 12 and its slat 1*b*.

Still further, the gear faces 10*a*, 10*b* are, as indicated above, preferably serrations or toothed gear elements. When such serrated or toothed surfaces are used and if the operator pulls on the ball chain 8*a* for a sufficient distance beyond the point at which the worm 11 strikes the stop 15 or 16, then, in that event, there will be a series of bumpy or jerky movements of clutch parts 9*a* and 9*b* as they repeatedly move toward and away from each other. As will be apparent to those skilled in the art, this is caused by the teeth of gear face 10*a* riding over the teeth of gear face 10*b* because the walls 2*a*, 2*b* maintain them in resilient contact. However, for all practical purposes, the faces 10*a* and 10*b* are disengaged from any effective driving engagement since the clutch part 9*b* can no longer be rotated by clutch part 9*a* (part 9*b* being prevented from rotating by a stop 15 or 16, as above described).

Generally, such "bumpy" operation is not undesirably noisy or objectionable and serves the advantageous purpose of signalling the operator to stop operation of the ball chain 8*a*. However, surfaces other than serrated or toothed surfaces may be used for the faces 10*a*, 10*b*. A mere roughening of the surfaces may suffice. It is only necessary that these faces have sufficient friction to insure that rotation of part 9*a* will effect rotation of part 9*b* on the one hand and yet not be so great a friction as to prevent slippage of the face 10*a* past the face 10*b* when the worm thread 11 engages one of the stops 15 or 16. As will be apparent, the nature of the surfaces provided on the faces 10*a* and 10*b* in part depends on the degree of resiliency in the walls 2*a* and 2*b* and in part on other factors. As used herein and in the claims, the terms "disengage", "disengagement", "disengage said parts from driving engagement", and the like, have reference to that motion of parts 9a and 9b which permits the part 9a to rotate while the part 9b is prevented from doing so, even though they may still remain in partial or full contact with each other.

I claim:

1. A clutch mechanism for use in a venetian blind having at least one housing, a drive shaft, and at least one slat, which clutch mechanism is operatively connected between the drive shaft and said slat to rotate said slat about its longitudinal axis upon rotation of the drive shaft, the improvement comprising said clutch mechanism having a first part mounted for rotation in response to rotation of said drive shaft, said clutch also having a second part, said second part being operatively connected to said slat for rotation of such slat upon rotation of said second part, said first and second parts being mounted for relative movement with respect to each other, said housing including at least one resilient portion for resiliently imparting relative movement to said parts to effect driving engagement of parts with each other, and the resiliency of said resilient portion being such as to yield to permit relative movement between said parts and in a sufficient amount to disengage said parts from driving engagement with each other upon the application of excess torque to said drive shaft and said first part.

2. The clutch mechanism according to claim 1, in which said resilient portion is a wall of said housing.

3. The clutch mechanism according to claim 1, in which said at least one resilient portion comprises a pair of spaced walls, both of which are resilient.

4. The clutch mechanism according to claim 3, in which said first and second parts are mounted for rotation with respect to said walls.

5. The clutch mechanism according to claim 4, in which each of said parts is in engagement with one of said walls and is resiliently urged by its engaged wall toward the other of said parts.

6. The clutch mechanism according to claim 5, in which both of said parts are coaxial with said drive shaft and axially slidable with respect to said drive shaft.

7. The clutch mechanism according to claim 6, in which said walls are substantially parallel.

8. The clutch mechanism according to claim 7, in which said first part has a drive face, said second part has a driven face positioned in opposition to said drive face, and said driving engagement and disengagement includes driving engagement and disengagement of said faces.

9. The clutch mechanism according to claim 8, in which said faces are complimentary toothed gear faces.

10. The clutch mechanism according to any one of the preceding claims, in which the operative connection between said second part and said slat includes said second part being a worm gear, a gear wheel, said worm gear being in engagement with said gear wheel, said gear wheel being connected to said slat, and at least one stop on said gear wheel engageable by the thread of said worm gear to arrest rotation of said second part upon engagement of said thread with said stop.

11. In a vertical venetian blind having an elongated top rail, a plurality of slat carriage-housings slidably supported by said top rail, a slat supported by each of said carriage-housings for rotation with respect thereto, a rotatable drive shaft, and a clutch operatively connected between said drive shaft and each slat to rotate the slats upon rotation of the drive shaft, the improvement comprising each of said clutches having a first part slidably mounted on said drive shaft, said first part being mounted for rotation with but non-rotatable with respect to said drive shaft, said clutch also including a rotatable second part, said second part being operatively connected to a slat for rotation of said slat upon rotation of said second part, said first part having a drive means, said second part having a driven means, said first and second parts being mounted for relative movement with respect to each other, said housing including at least one resilient portion for resiliently imparting relative movement to said first and second parts in a manner to engage said drive means and said driven means, and the resiliency of said resilient portion being such as to yield to permit relative movement between said first and second parts in a manner and in sufficient amount to disengage said drive means and said driven means upon the application of excess torque to said first part.

* * * * *

UNITED STATES PATENT AND TRADEMARK OFFICE

CERTIFICATE OF CORRECTION

PATENT NO. : 4,267,875

DATED : May 19, 1981

INVENTOR(S) : Marinus F. Koks

It is certified that error appears in the above—identified patent and that said Letters Patent is hereby corrected as shown below:

In Item (73) Page 1, after "Netherlands" insert "Antilles"

Signed and Sealed this

*Thirteenth* Day of *October 1981*

[SEAL]

*Attest:*

GERALD J. MOSSINGHOFF

*Attesting Officer*

*Commissioner of Patents and Trademarks*